United States Patent [19]

Kaldenhoven

[11] Patent Number: 4,924,142

[45] Date of Patent: May 8, 1990

[54] LOW PRESSURE MERCURY VAPOR DISCHARGE LAMP

[75] Inventor: Lambert C. I. Kaldenhoven, Eindhoven, Netherlands

[73] Assignee: U.S. Philips Corporation, New York, N.Y.

[21] Appl. No.: 239,823

[22] Filed: Sep. 2, 1988

[30] Foreign Application Priority Data

Sep. 8, 1987 [NL] Netherlands ..... 8702123

[51] Int. Cl.[5] ..... H01J 61/20

[52] U.S. Cl. ..... 313/490; 313/161; 313/565; 313/639

[58] Field of Search ..... 313/490, 565, 639, 161

[56] References Cited

U.S. PATENT DOCUMENTS 3,890,531 6/1975 Panofski et al. ..... 313/490

*Primary Examiner*—Kenneth Wieder

*Attorney, Agent, or Firm*—Norman N. Spain

[57] ABSTRACT

A low-pressure mercury vapor discharge lamp having a discharge vessel sealed in a gas-tight manner in which a discharge is present during operation of the lamp. The vessel contains a small quantity of an alloy comprising indium, tin and zinc forming an amalgam with mercury, the ratio between the atoms of indium and the atoms of tin in the amalgam-forming alloy being between 3:1 and 8:1, the ratio between the sum of the atoms of indium and tin and the atoms of zinc being between 95:5 and 99:1 and the ratio between the sum of the atoms of indium, tin and zinc and the atoms of mercury being between 95:5 and 99:1.

5 Claims, 2 Drawing Sheets

LOW PRESSURE MERCURY VAPOR DISCHARGE LAMP

BACKGROUND OF THE INVENTION

Figure 1:
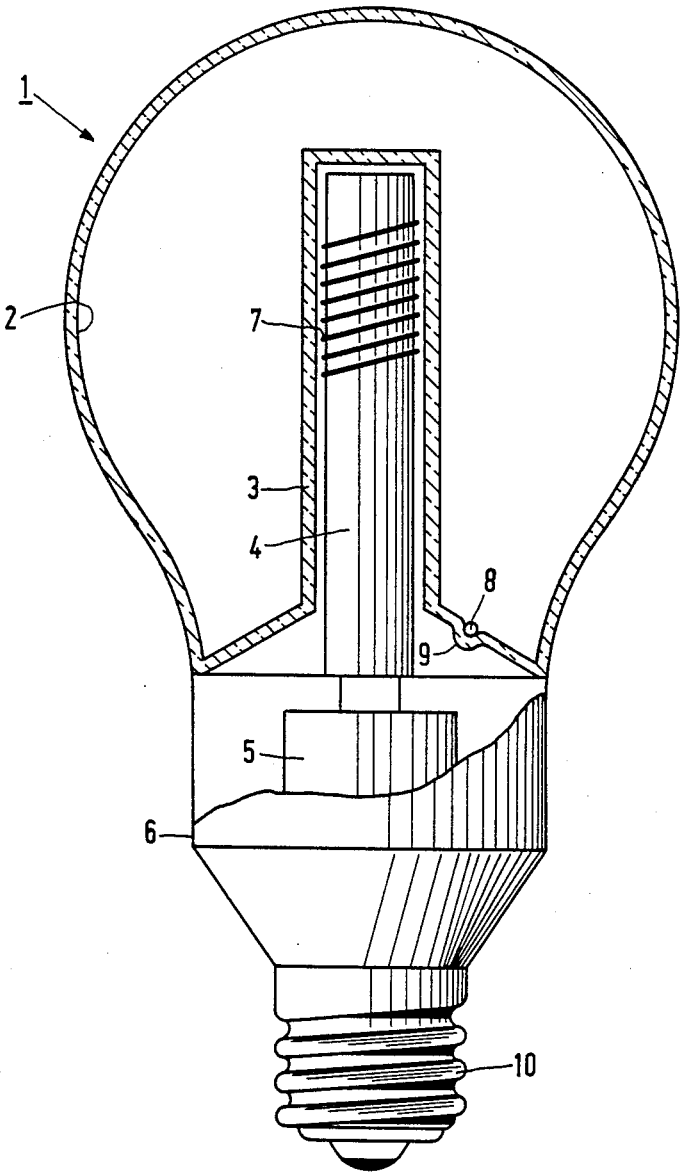

The invention relates to a low-pressure mercury vapor discharge lamp having a discharge vessel sealed in a gas-tight manner in which a discharge is present during operation of the lamp, said discharge vessel containing a small quantity of an alloy comprising indium, tin and zinc, which alloy forms an amalgam with mercury.

A lamp having a discharge vessel containing an amalgam comprising a metal of the group of indium, cadmium, gallium, gold, lead, tin and zinc or alloys of these metals is described in U.S. Pat. No. 4,105,910. This patent relates particularly to a low-pressure mercury vapor discharge lamp in which indium or an indium alloy with mercury as a starter amalgam is used. Such a starter amalgam is provided on a location in the lamp which is relatively hot during operation of the lamp, for example in the proximity of an electrode. When starting the lamp much mercury is released rapidly. Such a starter amalgam usually has a rich mercury content.

In addition to starter amalgams, amalgams are also known which are used in a low-pressure mercury vapor discharge lamp for stabilizing the mercury vapor pressure in the discharge vessel during operation of the lamp. The operating range of such an amalgam is determined by the temperature interval within with the mercury vapor pressure is substantially constant. This constant pressure, which occurs in the operating range, is also referred to as the plateau pressure. For low-pressure mercury vapor discharge lamps it generally holds that the light output is maximum at a mercury vapor pressure of approximately $6\times10^{-3}$ torr. An amalgam which is used for the mercury vapor pressure control in a low-pressure mercury vapor discharge lamp thus must preferably have a plateau pressure of approximately $6\times10^{-3}$ torr. Generally, the operating range of the known amalgams having a plateau pressure of approximately $6\times10^{-3}$ torr is in a temperature interval below 100° C.

For low-pressure mercury vapor discharge lamps such as electrodeless low-pressure mercury vapor discharge lamps having a spherical discharge vessel of, for example a diameter of approximately 110 mm and tubular low-pressure mercury vapor discharge lamps in, for example irradiation apparatus which are subjected to a relatively high load, it has been found that the light output is maximum at a mercury vapor pressure of approximately $3\times10^{-3}$ torr. Moreover the temperature in such a lamp subjected to a relatively high load can easily rise to over 100° C. during operation of the lamp. If the mercury vapor pressure for such lamps must be stabilized by means of an amalgam, an amalgam should be available which has a plateau pressure of approximately $3\times10^{-3}$ torr and whose operating range is in a temperature interval of over 100° C.

SUMMARY OF THE INVENTION

The object of the invention is to provide a low-pressure mercury vapor discharge lamp having an amalgam whose plateau pressure is approximately $3\times10^{-3}$ torr and whose operating range is above 100° C.

According to the invention a low-pressure mercury vapor discharge lamp of the type described in the opening paragraph is therefore characterized in that the ratio between the atoms of indium and the atoms of tin in the amalgam-forming alloy is between 3:1 and 8:1, the ratio between the sum of the atoms of indium and tin and the atoms of zinc being between 95:5 and 99:1, and the ratio between the sum of the atoms of indium, tin and zinc and the atoms of mercury being between 95:5 and 99:1.

Tests with an amalgam in a discharge vessel, which amalgam comprises indium, tin and zinc in the ratios according to the invention, have proved that the mercury vapor pressure is stabilized at a value of approximately $3\times10^{-3}$ torr in a relatively broad temperature interval above 100° C. It has been found that if less than 3 atoms of indium are present per atom of tin, the mercury vapor pressure is stabilized near the correct value, but the operating range of the amalgam, notably in the said lamps, is at a too low temperature. The temperature interval of the operating range is then partly below 100° C. However, if per atom of tin more than eight atoms of indium are present, the plateau pressure of the amalgam is too high, i.e. higher than approximately $4\times10^{-3}$ torr. Due to the presence of zinc in the amalgam an extra plateau pressure decrease is realized in the operating range of the said amalgam. If less than 1 atom % of zinc is present, the effect of this extra plateau pressure decrease is too small so that the plateau pressure is again too high. A zinc content of more than 5 atom % has proved that a phase which is rich in zinc is easily separated, which is detrimental for the mercury vapor pressure controlling effect of the amalgam. Furthermore between 1 and 5 atom % of mercury is present in the amalgam. If the mercury content is lower than 1 atom %, the mercury vapor pressure curve has an irregular variation. The mercury vapor pressure is then insufficiently stable. For a mercury content of more than 5 atom % it has been found that the operating range is again in a too low temperature interval.

A preferred embodiment of a low-pressure mercury vapor discharge lamp according to the invention is characterized in that the ratio between the sum of the atoms of indium, tin and zinc and the atoms of mercury is between 97.5:2.5 and 98.5:1.5.

If the amalgam contains approximately 2 atom % of mercury, a very flat plateau with a plateau pressure of approximately $3\times10^{-3}$ torr occurs in a temperature interval which is completely above 100° C.

In another preferred embodiment of a low-pressure mercury vapor discharge lamp according to the invention the ratio between the atoms of indium and the atoms of tin is between 4.5:1 and 5.5:1.

If approximately five times as much indium as tin is present in the amalgam, the plateau pressure is approximately $3\times10^{-3}$ torr, while the operating range of the amalgam extends over a relatively broad temperature interval between 105° C. and 130° C. This is notably advantageous in electrodeless low-pressure mercury vapor discharge lamps.

Favourable results are obtained with a low-pressure mercury vapor discharge lamp according to the invention in which the ratio In:Sn:Zn in the amalgam-forming alloy is in the proximity of 82.5:16:1.5. This composition is a eutectic.

Due to the location of the plateau pressure and the temperature interval of the operating range, an amalgam according to the invention is particularly suitable for use in a spherical electrodeless low-pressure mercury vapor discharge lamp (for example, having a diameter of approximately 110 mm). Such a lamp is known from U.S. Pat. No. 4,622,495. Such an amalgam is also suitable for use in a high-load low-pressure mercury vapor discharge lamp (for example, a compact fluorescent lamp) or an elongate tubular lamp as used, for example in irradiation apparatus.

Figure 2:
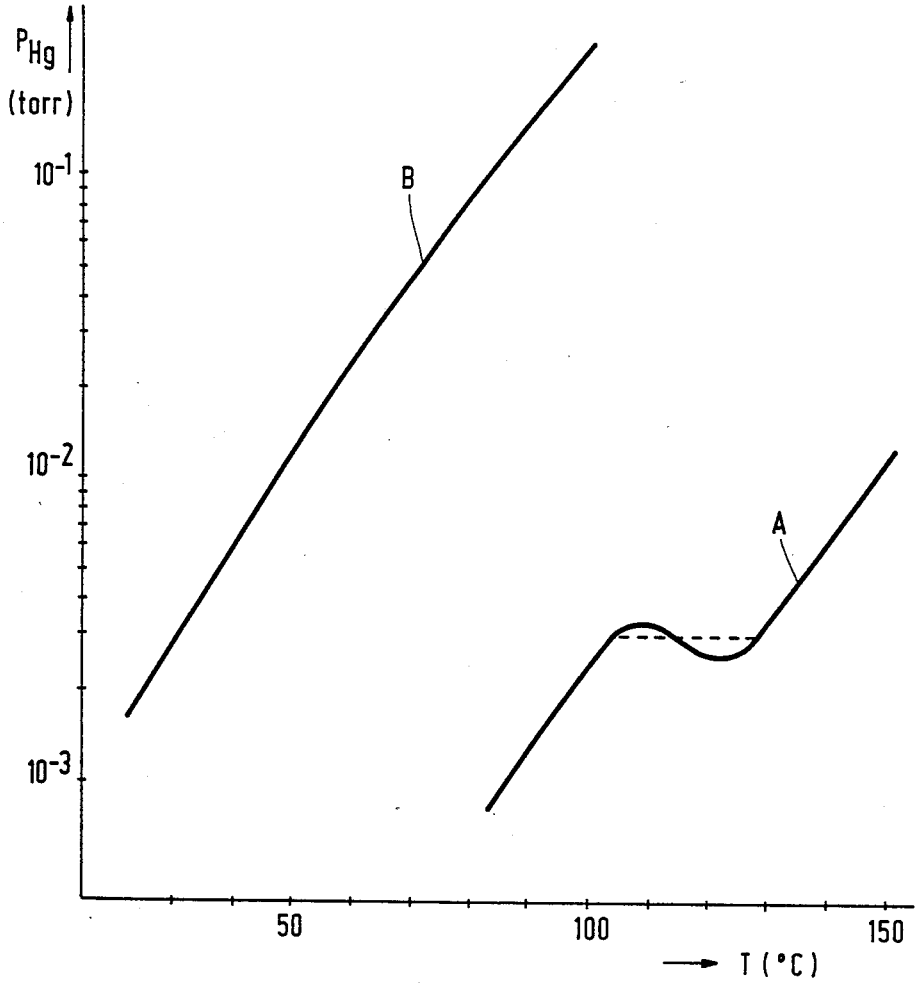

The invention will now be described in greater detail by way of example with reference to the accompanying drawing in which FIG. 1 shows a spherical electrodeless low-pressure mercury vapor discharge lamp, provided with an indium, tin and zinc-containing amalgam according to the invention, and FIG. 2 is a graph showing the mercury vapor pressure $p_{Hg}$ in torr as a function of the temperature T in °C. in a discharge vessel containing an amalgam according to the invention (curve A) and in a discharge vessel containing pure mercury (curve B).

The lamp according to FIG. 1 has a glass lamp vessel 1 sealed in a gas-tight manner and filled with a quantity of mercury and a rare gas such as krypton during operation of the lamp. A layer 2 of a luminescent material by means of which the UV-radiation generated in the lamp vessel is converted into visible light is provided on the inner wall of the lamp vessel. A tubular indentation 3 in the wall of the lamp vessel accommodates a rod-shaped core 4 of a magnetic material. An electric supply unit 5, which is present in a partly tapered housing 6 provided with a cap 10, induces a high-frequency magnetic field in the core during operation of the lamp by means of a coil 7 connected to the supply unit (not shown in the drawing) and wound around this core. An electric discharge is then generated in the lamp vessel.

In the embodiment shown the lamp vessel contains an amalgam to control the mercury vapor pressure during operation of the lamp. This amalgam is denoted by the reference numeral 8 and is present in a recess 9 at a relatively cool location in the inner wall. The amalgam 8 comprises an alloy of indium, tin, zinc and mercury according to the invention.

In FIG. 2 curve A indicates the mercury vapor pressure $p_{Hg}$ (in torr) as a function of the temperature T in °C. if an amalgam-forming alloy whose atomic ratio of the elements In:Sn:Zn is equal to 82.5:16:1.5 is used in a discharge vessel. A given quantity of mercury is added to this alloy so that the amalgam comprises 2 atom % of mercury. A property of such a eutectic mixture is that the composition of the liquid phase changes as a function of temperature. Curve A shows that the temperature interval of the operating range of the amalgam (the plateau) is between 105° C. and 130° C. In this temperature interval the mercury vapor pressure remains approximately constant. The plateau pressure is $3\times10^{-3}$ torr, denoted by the broken line. Below 105° C. the amalgam is in a solid phase. For the purpose of comparison FIG. 2 shows curve B. This curve indicates the mercury vapor pressure of pure mercury in a discharge vessel as a function of temperature.

What is claimed is:

1. A low-pressure mercury vapor discharge lamp having a discharge vessel sealed in a gas-tight manner in which a discharge is present during operation of the lamp, said discharge vessel containing a small quantity of an alloy consisting essentially of indium, tin and zinc, which alloy forms an amalgam with mercury, and wherein the ratio between the atoms of indium and the atoms of tin in the amalgam-forming alloy is between 3:1 and 8 1, the ratio between the sum of the atoms of indium and tin and the atoms of zinc being between 95:5 and 99:1, and the ratio between the sum of the atoms of indium, tin and zinc and the atoms of mercury being between 95:5 and 99:1.

2. A low-pressure mercury vapor discharge lamp as claimed in claim 1, wherein the ratio between the sum of the atoms of indium, tin and zinc and the atoms of mercury is between 97.5:2.5 and 98.5:1.5.

3. A low-pressure mercury vapor discharge lamp as claimed in claim 1, wherein the ratio between the atoms of indium and the atoms of tin is between 4.5:1 and 5.5:1.

4. A low-pressure mercury vapor discharge lamp as claimed in claim 1, wherein the ratio In:Sn:Zn in the amalgam-forming alloy is in the proximity of 82.5:16:1.5.

5. A low-pressure mercury vapor discharge lamp as claimed in claim 1, provided with a spherical discharge vessel.

* * * * *